US006303054B1

(12) United States Patent
Kanetake et al.

(10) Patent No.: US 6,303,054 B1
(45) Date of Patent: Oct. 16, 2001

(54) ELECTRICALLY-SEMICONDUCTIVE POLY(AMIC ACID) LIQUID COMPOSITIONS AND THEIR USE

(75) Inventors: Junya Kanetake, Moriyama; Tsutomu Yoshida, Otsu; Naoki Nishiura, Moriyama; Tsuneo Miyamoto, Moriyama; Takashi Kuraoka, Moriyama, all of (JP)

(73) Assignee: Gunze Limited, Kyoto-fu (JP)

( * ) Notice: Subject to any disclaimer, the term of this patent is extended or adjusted under 35 U.S.C. 154(b) by 0 days.

(21) Appl. No.: 09/638,343

(22) Filed: Aug. 14, 2000

(51) Int. Cl.[7] ..... H01B 1/24
(52) U.S. Cl. ..... 252/511
(58) Field of Search ..... 252/511; 524/495, 524/496

(56) References Cited

U.S. PATENT DOCUMENTS

| | | | | |
|---|---|---|---|---|
| 5,021,036 | | 6/1991 | Tanaka et al. . | |
| 5,078,936 | * | 1/1992 | Parish et al. | 264/105 |
| 5,174,924 | * | 12/1992 | Yamada et al. | 252/511 |
| 5,389,412 | | 2/1995 | Tanaka et al. . | |
| 6,001,440 | | 12/1999 | Miyamoto et al. . | |

FOREIGN PATENT DOCUMENTS 5-77252 3/1993 (JP) .
10-2968264 11/1998 (JP) .

* cited by examiner

*Primary Examiner*—Mark Kopec
(74) *Attorney, Agent, or Firm*—Knobbe, Martens, Olson & Bear, LLP

(57) ABSTRACT

The present invention provides an electrically-semiconductive poly(amic acid) liquid composition and a use thereof. An electrically-semiconductive poly(amic acid) (polyimide precursor) liquid composition whose electrical semiconductivity is applied by comprising an electrically-conductive carbon black. Change in an electrical resistivity of the liquid composition after being stored for 180 days at a temperature of 23° C. and in an atmosphere of a RH of 65% is 7% or less based on the electrical resistivity immediately after the preparation of the liquid composition. The electrically-semiconductive poly(amic acid) liquid composition is obtainable by mixing 5–40 parts by weight of a poly(amic acid), 95–60 parts by weight of an organic polar solvent and 10–40% by weight based on the poly(amic acid) of an electrically-conductive carbon black having a volatile content of 5–20%, a specific surface area of 100–300 $m^2/g$ and a pH of 2–4. The electrically-semiconductive poly(amic acid) liquid composition is used for molding an electrically-semiconductive seamless tubular polyimide film, for example, which is usable as an intermediate belt member for fixation and transfer of toner in a copying machine.

4 Claims, 1 Drawing Sheet

ELECTRICALLY-SEMICONDUCTIVE POLY(AMIC ACID) LIQUID COMPOSITIONS AND THEIR USE

FIELD OF THE INVENTION

The present invention relates to an electrically-semiconductive poly(amic acid) liquid composition excellent in storage stability and to a use thereof for producing an electrically-semiconductive seamless tubular polyimide film. The electrically-semiconductive seamless tubular polyimide film is useful, for example, as an intermediate belt member for fixation and transfer in a copying machine.

BACKGROUND OF THE INVENTION

It is well known to prepare an electrically-semiconductive polyimide by incorporating an electrically-conductive carbon black and to mold the electrically-semiconductive polyimide in the form of a film (sheet, tube, etc), for example, for using the film for various types of applications. Conventionally, in the production process, a liquid composition of poly(amic acid) (hereinafter referred to as "conventional liquid composition") is first prepared by synthesizing poly(amic acid), which is a precursor of polyimide, in an organic polar solvent, followed by adding thereto the electrically-conductive carbon black to be mixed therewith. Viscosity of the resultant liquid composition can be adjusted by adding the organic polar solvent to suit preferable molding conditions. Thereafter, the liquid composition is used for molding a film, for example, wherein the following two steps are necessary. In the first step, the liquid composition is molded under the molding conditions where the poly(amic acid) used as a main ingredient is not imidated (the molding temperature is less than 250° C.) and by desired means to obtain the molded product in a desired form. The organic polar solvent contained in the liquid composition is removed by evaporation to give a solid poly(amic acid) film containing the carbon black. In the second step, the poly(amic acid) film is gradually heated until the temperature reaches about 350° C. so that the imidation is complete to give an electrically-semiconductive polyimide film with removing the remaining solvent by evaporation, thereby finishing the production process.

The inventors of the present invention have filed a number of patent applications in connection with the techniques explained above. However, during various types of research for improving the techniques, the inventors have found the following problems which should have been resolved at once.

One of the problems relates especially to the conventional liquid composition. The inventors found that the conventional liquid composition sharply changes in the electrical resistivity day by day when stored in ordinary state (at ordinary temperature and under atmospheric pressure). The electrical resistivity changes with time; it decreases in some cases and increases in other cases. The change in the electrical resistivity makes it impossible to obtain a desired molded product having a desired electrical resistivity unless the liquid composition is subjected to a molding immediately after the production. Because of the unstable electrical resistivity, the liquid composition cannot be prepared in a large scale to be stored and used in such a manner that a portion required for the production process is taken out of the stock. That is, a mass-production of the liquid composition is practically impossible.

Another problem is a nonuniform electrical resistivity of a molded product. It is possible to produce a molded product having a desired electrical resistivity from the unstable liquid composition if the liquid composition is molded immediately after the preparation. However, depending on use conditions of the molded product (for example, a long-term use with repetitive electrification and destaticization under a high voltage, such as an intermediate transfer belt in a color copying machine; a long-term use under a high temperature and high humidity; etc.), variations in the electrical resistivity occur, thereby preventing the molded product from maintaining the uniformity in the electrical resistivity once applied to the molded product.

The inventors carried out an extensive research to solve the above problems at once, and found a novel electrically-semiconductive poly(amic acid) composition which has a higher storage stability and maintains a stable electrical resistivity as being molded into a molded product, thereby to accomplish the present invention. The invention is easily achieved as described below.

SUMMARY OF THE INVENTION

The invention provides an electrically-semiconductive poly(amic acid) liquid composition (PA liquid composition) as recited in claim 1, whose electric semiconductivity is imparted by an electrically-conductive carbon black contained therein, characterized in that a change in an electrical resistivity of the liquid composition is 7% or less with respect to an initial electrical resistivity after being stored at least for 180 days at a temperature of 23° C. and in an atmosphere of RH of 65%. The electrically-semiconductive poly(amic acid) liquid composition having the above characteristics can solve the problems mentioned above. Thus, a novel electrically-semiconductive poly(amic acid) liquid composition (hereinafter "PA liquid composition") is provided.

One of the embodiments of the PA liquid composition is provided by claim 2, wherein the PA liquid composition comprises 5–40 parts by weight based on poly(amic acid), of a poly(amic acid), 95–60 parts by weight of an organic polar solvent and 10–40% by weight of an electrically-conductive carbon black having a volatile content of 5–20% by weight, a specific surface area of 100–300 $m^2/g$ and a pH of 2–4. Of course, this is one of the examples for the preferred embodiments of the PA liquid composition, and the invention is not limited thereto.

A preferred example of the use of the PA composition is recited in claim 4, wherein an electrically-semiconductive seamless tubular polyimide film is produced by using the PA composition. The electrically-semiconductive seamless tubular polyimide film (hereinafter referred to as SL film) thus obtained is usable, for example, as an intermediate belt member for fixation and transfer in a color copying machine.

In claim 3, the poly(amic acid) which is a thermosetting polyimide precursor is provided. Not only the thermosetting polyimide precursor, but also a polyamideimide precursor is included in poly(amic acids); however, the thermosetting polyimide precursor is more effectively used as described below.

BRIEF DESCRIPTION OF THE DRAWINGS

In FIG. 1, the plotted line 1 demonstrates the results of Example 1, and the plotted line 2 demonstrates the results of Comparative Example 1.

DISCLOSURE OF THE INVENTION

Figure 1:
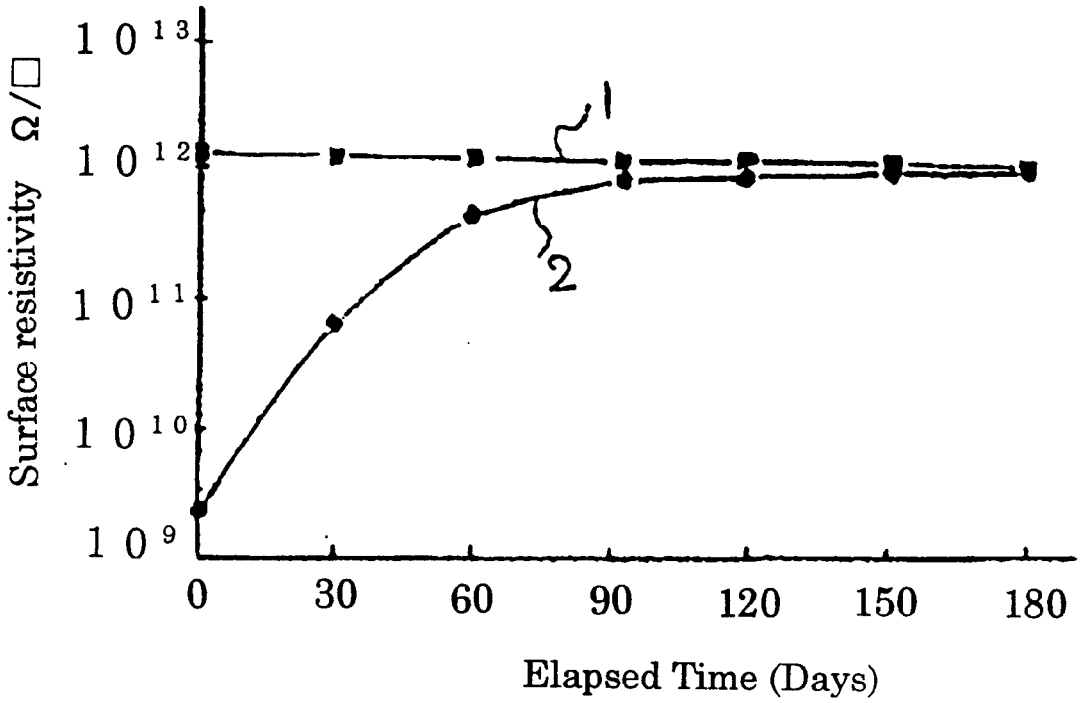
FIG. 1 is a graph showing a change in the surface resistivity with respect to a change with time of a PA solution composition.

The invention will hereafter be described in detail.

First, the poly(amic acids), electrically-conductive carbon blacks and organic polar solvents involved in the PA liquid composition of the invention are explained.

Poly(amic acids) are precursors of polyimide or polyamideimide, i.e. polymers before the imide ring closure having a common property to be dissolved in a certain organic polar solvent. Specifically, the polyimide precursors are obtainable basically by a polycondensation reaction of equivalent amounts of an organic acid dianhydride and an organic diamine in an organic polar solvent at a low temperature (where no imidation reaction can occur). Examples of the organic acid dianhydride are pyromellitic dianhydride, 2,2',3,3'-biphenyl-tetracarboxylic dianhydride, 3,3',4,4'-benzophenonetetracarboxylic dianhydride, 3,3',4,4'-biphenyl-tetracarboxylic dianhydride, bis(2,3-dicarboxyphenyl)methane dianhydride, and the like. Examples of the organic diamine are bis[4-{3-(4-aminophenoxy)benzoyl}phenyl]ether, 4,4'-bis(3-aminophenoxy)biphenyl, bis[4-(3-aminophenoxy)phenyl]sulfone, 2,2'-bis[4-(3-aminophenoxy)phenyl]propane, etc. (herein after referred to as "diamine group A"), p-phenylenediamine, 4,4'-diaminodiphenyl, 4,4'-diaminodiphenylmethane, 4,4'-diaminophenylether, etc. (hereinafter referred to as "diamine group B"). The compounds of both of the groups A and B can be used in combination as required to prepare the PA liquid composition. When only the compound of diamine group A is used, the resultant polyimide is thermoplastic. In contrast, when only the compound in diamine group B is used, the resultant polyimide is thermosetting.

A polyimide having amide groups in the backbone, which is a polyimide precursor generally referred to as polyamideimide, is obtainable basically by a polycondensation reaction of equivalent amounts of an organic anhydride, i.e. an tricarboxylic anhydride and an organic diamine in the organic polar solvent at a low temperature (where no imidation can occur). Specifically, trimellitic anhydride is representative of the organic acid anhydride, and a compound selected from either diamine group A or diamine group B can be used as the organic diamine.

Among the above examples of polyimide precursors, the thermosetting polyimide precursor is preferred because of the higher heat resistance, dimensional stability, strength, etc. in view of the properties of the final polyimide molded product.

In addition, the poly(amic acid) can be obtained in the form of a powder by adding a non-polar solvent with stirring to the organic polar solution wherein the poly(amic acid) obtained above is dissolved.

Next, explanations are given below for the electrically-conductive carbon black or blacks (hereinafter referred to as "EC black or EC blacks") to be used for imparting at least a semiconductivity (in general, from $10^1$ to $10^{14}$ Ω·cm of the electrical resistivity) to the poly(amic acid).

The EC blacks typically have electrical resistivity from $10^{-1}$ to $10^4$ Ω/□, and can be produced by burning raw materials such as a natural gas, acetylene gas, anthracene, naphthalene, coal tar, oils, etc. Of course, the type of the raw material, burning conditions, etc. affect a resultant EC black in various properties including the electrical resistivity. Accordingly, EC blacks are categorized under the names of acetylene black, oil furnace black, channel black, thermal black, etc.

The organic polar solvent to be used in the invention is not limited as long as an polyamide is soluble therein. Specifically, aprotic solvents such as N-methylpyrrolidone, dimethylacetoamide, dimethylformamide, dimethylmethoxyacetoamide, N-methylcaprolactone, dimethylsulfoxide, 1,3-dimethyl-2-imidazolidinone, etc may be used as the organic polar solvent.

However, a PA liquid composition prepared by combining the above ingredients to impart the electrical semiconductivity thereto is not the characteristics of the invention. Specifically, the change in the electrical resistivity of the liquid composition must be maintained at 7% or less, preferably 5% or less, based on the initial electrical resistivity after being stored at least for 180 days at a temperature of 23° C. and in an atmosphere of RH of 65%. If the change in the electrical resistivity of the PA liquid composition exceeds 7%, the desired electrical resistivity cannot always be achieved and, therefore, the strategy of mass-production of the PA liquid composition from which a desired portion is taken out from time to time is not successful. Besides, even in the case where a molded product is produced by subjecting the PA liquid composition to molding immediately after the preparation, variations and unevenness in the electrical resistivity occur depending on the use conditions of the molded product (for example, a long-term use with repetitive electrification and destaticization under a high voltage, e.g. as an intermediate transfer belt in a color copying machine, a long-term use in a high temperature and high humidity, etc.), to prevent the molded product from maintaining the uniformity in the electrical resistivity once applied to the molded product.

If the PA liquid composition of the invention satisfies the above-described parameter, the components and preparation processes thereof are not limited. The PA liquid composition of the invention can be prepared from the ingredients suitably selected from the above by a suitable preparation process. The following is one of the preferred techniques for the preparation of the PA liquid composition.

The preferred ingredients and composition of components are recited in claim 2. More specifically, the liquid composition of the invention preferably comprises 5–40 parts by weight of a poly(amic acid), 95–60 parts by weight of an organic polar solvent and 10–40% by weight based on the poly(amic acid) of an EC black having a volatile content of 5–20%, preferably 7–18%, a specific surface area of 100–300 $m^2/g$, preferably 130–250 $m^2/g$ and a pH of 2–4, preferably 2.5–3.5. Here, 100 parts by weight is composed of the poly(amic acid) and solvent. The amount of the solvent is set in a certain range where the amount is required for dissolving the poly(amic acid) to have the mixture in the form of a liquid (at a temperature from 50° C. to room temperature; in the ordinary temperature range) and for obtaining the resulting molded product in a desired form. The EC black produces a synergy effect, i.e., the EC black is dispersed uniformly in the poly(amic acid) solution with a sufficient affinity, and the state of dispersion does not change with time (the state of dispersion during initial phase of preparation is maintained), whereby maintaining the electrical semiconductivity as imparted. Therefore, if the EC black lacks in any one the characteristics and ranges, the EC black does not function satisfactorily.

Functions of each of the characteristics of the EC black is hereafter described. The volatile content mainly relates to maintaining the affinity of the EC black for the poly(amic acid) containing the organic polar solvent and the stability of the electrical resistivity. The specific surface area relates to the adhesive action of the poly(amic acid) to the surface of EC black particles. The specific surface area relates to a particle size, shape and roughness of the EC black particle. The synergy effect cannot be produced if the adhesive action is too low or too high. Accordingly, a suitable range of the specific surface area is within the range of 5–20% as mentioned above. The pH functions additionally to the volatile content to achieve the satisfactory affinity and electrical resistivity. The affinity is resulted chiefly from acidic oxides (carboxyl group, phenolic hydroxy group-containing oxides, etc.) of the volatile content and, therefore, the affinity is improved as the pH is lowered. However, stability and persistency of the electrical resistivity are deteriorated if the pH is too low. The lowest pH is pH 2 since the degree of affinity is more preferable at the value, whereas the highest pH is set as pH 4 so that the electrical resistivity be stable and well-balanced with the affinity. It is considered that the action for stabilizing and maintaining the electrical resistivity is effected not only by the acid oxides but also by other volatile contents such as quinone, lactone and the like.

The volatile content is an evaporated portion obtained by heating the EC black at 950° C. for 7 minutes and, therefore, corresponds to weight loss in the range of 5–20% of the EC black. The specific surface area is measured by BET method (nitrogen gas adsorption), and the pH is measured by using a pH meter having electrode systems.

Basically, one ingredient is selected from each of the components to be used in the invention. However, EC blacks having different ranges of the characteristics from those described above and, of course, EC blacks each having the specific ranges of the characteristics can be used in combination as long as the ranges resulting from the combination are within the specific ranges.

A preparation process of the PA liquid composition by mixing the above-described components is described by way of example in the following. First, a predetermined EC black is added to a poly(amic acid) solution (bulk solution) obtained by the polycondensation in an organic polar solvent to carry out a preliminary mixing using a dissolver (e.g., preliminary mixer having cup-shaped rotating blades). The preliminary mixture is then transferred to a sand mill together with zirconia balls to be further mixed with rotating the sand mill. A satisfactory dispersion is achieved by mixing using the sand mill. Since the stirring causes the temperature of the mixture to be elevated, the mixing is carried out preferably with cooling so that the temperature does not exceed 70° C. The mixing time depends on the amount of mixture, etc.

To attain the desired viscosity, the viscosity can be adjusted by adding the bulk solution or solvent to be mixed with the mixture.

The PA liquid composition has such a high stability that the electrical resistivity thereof is maintained at 7% or less after being stored for 180 days (in the air or in an inert gas) under the conditions of 23° C./RH 65% as described above and, therefore, the PA liquid composition can be securely used for various types of applications. For example, the PA liquid composition can be used as a semiconductive coating having a high heat resistance, chemical resistance, mechanical strength and the like or can be used in the form of a sheet (having a thickness of about 50–300 $\mu$m). The PA liquid composition is more effectively used in the form of a seamless tubular film, wherein a thermosetting polyimide is more satisfactorily used as a constituent material. This is because the seamless tubular film is typically used as an intermediate belt member for fixation and transfer in a copying machine (especially in a color copying machine).

Molding processes of the polyimide SL film are described by way of example in the following.

One example is a so-called centrifugal casting. In the centrifugal casting process, the PA liquid composition is poured into a molding drum, followed by high speed rotation with heating (the speed needs to be increased as the viscosity of the composition increases, though limited to a certain speed), thereby casting the PA liquid composition uniformly on the inner surface of the molding drum and removing the organic polar solvent by evaporation to give an electrically-semiconductive tubular poly(amic acid) film.

Another example of the molding process is different from the centrifugal casting, wherein the PA liquid composition is sprayed on the inner wall of the molding drum with heating while rotating the drum at a low speed which causes substantially no centrifugal force, thereby removing the organic solvent by evaporation in the same manner as that of centrifugal molding to give an electrically-semiconductive tubular poly(amic acid) film. This is a novel molding method which cannot be found in the conventional techniques. This is herein referred to as "spray molding" for convenience.

In comparison with the centrifugal casting, the spray molding is characterized in that: the molding can be carried out without being influenced by the concentration (low to high) of the PA liquid composition and under the molding conditions (rotation speed of the molding drum and heating temperature) which are substantially constant; high accuracy in thickness of the molded product; electrically-conductive carbon black is uniformly dispersed throughout the molded product (never gradient dispersion); the electrical semiconductivity provided is free from nonuniformity because of the uniformly dispersed carbon black; the molding time is shortened to about ½ to ⅓; a tubular molded product having a larger size can be easily produced with maintaining the aforementioned advantageous characteristics; and the like.

Electrically-semiconductive tubular poly(amic acid) films obtained in either of the molding methods are heated in a separate step (at about 400° C. or less) to carry out the imidation, whereby to give the final product.

The invention having the above-described constituent features produces the following effects.

Since the electrical resistivity of the PA liquid composition of the invention does not change with time at least for 180 days, it is possible to adopt a mass-production system wherein the PA liquid composition is prepared in a large quantity and stored to be used as required. This enables to secure the production and quality management of the PA liquid composition.

Further, the PA liquid composition of the invention is so stable that the electrical resistivity of various molded products obtained therefrom is free from the change with time and influences of the use condition, thereby attaining a secure performance.

The PA liquid composition of the invention can be used as a highly heat-resistant coating having an electrical semiconductivity (destaticization and a suitable electrification) or can be used for producing various molded products in the form of a sheet. Among the sheet-like molded products, a seamless tubular film, for example, is satisfactorily used as an intermediate belt member mounted in a color copying machine, the member which carries out fixation and transfer of toner images almost simultaneously.

BEST MODE FOR CARRYING OUT THE INVENTION

The invention will be illustrated in detail with referring to examples and a comparative example.

Note that each of electrical resistivity of the PA liquid compositions is determined after molding each of the PA liquid compositions into a polyimide film, specifically by measuring a surface resistivity of the polyimide film (by using "Hiresta", an electrical resistivity detector manufactured by Mitsubishi Yuka Kabushiki Kaisha).

Example 1

Prepared was 15 kg of a poly(amic acid) solution having a solid content of 18 wt. % by polycondensation of equivalent amounts of 3,3',4,4'-biphenyl-tetracarboxylic dianhydride and 4,4'-diaminodiphenyl ether in N-methylpyrrolidone (hereinafter referred to simply as "solvent") at ordinary temperature. An EC black having a volatile content of 14%, a pH of 3, a specific surface area of 180 $m^2/g$ selected from among a variety of channel carbon blacks (for reference, the EC black had an average particle size of 25 mμ and an oil absorption of 150 g/100 g) was weighed and 72 g (13.3 wt. % in the solid content) thereof was added to 3 kg of the poly(amic acid) solution which was taken out of the poly(amic acid) solution obtained above. The EC black was gradually added to the poly(amic acid) solution (3 kg) with stirring using a dissolver, and the stirring was continued for 50 minutes. The preliminary mixture was transferred to a sand mill together with zirconia bolls (having a diameter of 1.5 mm) and further mixed with rotation. In this mixing step, the mixture is tend to be heated due to the rotation (frictional heating) and, therefore, the mixture was stirred for 20 minutes with cooling to prevent the temperature from reaching 50° C. After completion of the stirring, viscosity of the mixture was measured to be 3,000 cP and, therefore, the viscosity was adjusted to 1,200 cP by adding the solvent. The mixture obtained above is hereinafter referred to as "Bulk Solution A".

Next, Bulk Solution A was allowed to stand in a room where the temperature and RH were regulated to be 23° C. and 65%, respectively, for 180 days to examine a change with time in the surface resistivity. In addition, a change in a dispersion state of the EC black was examined.

The examination of the change with time in the surface resistivity was carried out every 30 days for 6 times in the following procedures. First, a required amount of Bulk Solution A was sampled and casted on a glass plate to be gradually heated up to 120° C., thereby removing the solvent by evaporation. A poly(amic acid) film thus obtained was peeled off from the glass plate. Then, the film was placed in a hot air dryer in a state where the film was slightly stretched, followed by gradually heating the film up to 400° C. to remove the solvent completely and to accomplish the imidation. The polyimide film thus obtained was used as a sample immediately after the preparation of Bulk Solution A for the measurement of the surface resistivity. Thereafter, a film molding was carried out every 30 days in the same manner as that described above, wherein a sample film was produced to measure the surface resistivity. Film thickness of each of the obtained films was 90 μm.

The change in the dispersion state of the EC black was assessed twice, firstly at immediately after the preparation of Bulk Solution A and secondly at after 180 days of the standing, in such a manner that a portion of Bulk Solution A was sampled to measure the median diameter so as to detect the change in diameters of dispersed particles of the EC black. When no change was observed in the diameters of dispersed particles, it means that there was no unevenness in the dispersion state.

The measurement results are shown in Graph 1 of FIG. 1. Graph 1 reveals that the surface resistivity is substantially unchanged, i.e. the electrical resistivity of Bulk Solution A is not more than 7% and near to 0%. The median diameter of the EC black immediately after the preparation of Bulk Solution A was 0.329 μm and that of after 180 days of standing was 0.328 μm, which reveals that the dispersion status was also unchanged (it is considered that there was no EC black aggregation).

Comparative Example 1

Except for using 3 kg taken out of the residual portion (12 kg) of the poly(amic acid) solution obtained in Example 1 and an EC black having a volatile content of 1.5%, a pH of 3.5, a specific surface area of 114 $m^2/g$ which was selected from among a variety of oil furnace blacks in an amount of 72 g (13.3 wt. % in the solid content; for reference, the EC black had an average particle size of 22 mμand an oil absorption of 100 g/100 g), mixing was carried out in the same manner as that of Example 1, and then the mixture was examined with respect to changes with time of surface resistivity and dispersion state over 180 days. The change in the surface resistivity is shown in Graph 2 of FIG. 1. Graph 2 reveals that the surface resistivity sharply changed with time. The median diameter of immediately after the preparation of the present bulk solution was 0.391 μm and that of after 180 days of standing was 1.210 μm. which reveals that the dispersion status changed sharply (this is considered to be caused by aggregation of the EC black).

Example 2

Except for using 3 kg taken out of the residual portion (9 kg) of the poly(amic acid) solution obtained in Example 1, a bulk solution was prepared in the same manner as that of Example 1 by adding and mixing the EC black and adjusting the viscosity of the mixture to 1200 cP. The bulk solution thus obtained is hereinafter referred to as "Bulk Solution B".

Meanwhile, 3 kg taken out of the residual portion (6 kg) of the poly(amic acid) solution obtained in Example 1 was used to prepare a bulk solution in the same manner as that of Comparative Example 1 by adding and mixing the EC black and adjusting the viscosity to 1200 cP. The bulk solution thus obtained is hereinafter referred to as "Bulk Solution C".

Note that a small amount (about 1% by weight of a bulk solution) of a fluorine-containing surfactant (EFTOP•Type EF-351 manufactured by Mitsubishi Material Kabushiki Kaisha) was added to both of the bulk solutions to enhance the flow-out properties. The bulk solutions were then degassed.

Polyimide SL films were prepared from Bulk Solution B and Bulk Solution C by centrifugal casting under the following conditions.

Note that there was no special reason for not employing the above-mentioned spray casting as a molding method other than that the molding drum used was small and the solutions had low viscosity.

Molding Apparatus

A molding drum is mounted on a pair of revolving rollers so that the molding drum is rotated via the rotation of rollers. The molding drum having an inside diameter of 170 mm and a width of 550 mm is made of stainless steel and has a mirror-finished inner surface. Bearers for preventing leakage are provided on both inner peripheral edges. Heating is performed by a far infrared radiation heater provided on upper portion of the drum and a preheater provided in the revolving rollers.

Molding Conditions

Common to both of Bulk Solution B and Bulk Solution C. A bulk solution was poured streakily into the drum which is not rotated. The drum was rotated and heated gradually. The rotating and heating were carried out until a revolution and a temperature reached 700 rpm and 100° C., respectively, then the revolution and temperature were maintained for 120 minutes. During the procedure, the solvent in the bulk solution was evaporated, whereby giving a poly(amic acid) tubular film. The film was peeled off from the inner surface of the drum.

Imidation

The poly(amic acid) tubular film was fitted on a cylindrical mold made of stainless steel having an outside diameter of 169 mm and a length of 400 mm. Then, the mold with the film was placed in an hot air dryer, and the dryer was gradually heated until the heating temperature reached 350° C. The temperature was maintained for 20 minutes. Complete removal of the solvent was carried out simultaneously with the imidation, whereby to give an electrically-semiconductive thermosetting polyimide SL film.

In addition, the cylindrical mold was employed since it has the advantage of retaining the form of the film during the imidation. Hereafter, the polyimide SL film made of Bulk Solution B is referred to as "Film B", and that made of Bulk Solution C is referred to as "Film C".

In addition, it was confirmed that Film B is useful as an intermediate belt for fixation and transfer in a color copying machine.

What is claimed is:

1. An electrically-semiconductive poly(amic acid) liquid composition, characterized in that the electrical semiconductivity is imparted by an electrically-conductive carbon black and that the change in an electrical resistivity of the liquid composition after being stored for 180 days at a temperature of 23° C. and in an atmosphere of RH of 65% is 7% or below based on the initial electrical resistivity.

2. The electrically-semiconductive poly(amic acid) liquid composition according to claim 1, comprising 5–40 parts by weight of a poly(amic acid), 95–60 parts by weight of an organic polar solvent and 10–40% by weight based on the poly(amic acid) of an electrically-conductive carbon black having a volatile content of 5–20%, a specific surface area of 100–300 $m^2/g$ and a pH of 2–4.

3. The electrically-semiconductive poly(amic acid) liquid composition according to claim 1, wherein the poly(amic acid) is a precursor of thermosetting polyimide.

4. The electrically-semiconductive poly(amic acid) liquid composition according to claim 1, which is used for molding an electrically-semiconductive seamless tubular polyimide film.

* * * * *